US005354189A

United States Patent [19]

McKinnon

[11] Patent Number: 5,354,189

[45] Date of Patent: Oct. 11, 1994

[54] CURB FORMING AND EXTRUDING APPARATUS

[76] Inventor: Paul M. McKinnon, 807 W. Forest, Brigham City, Utah 84302

[21] Appl. No.: 998,690

[22] Filed: Dec. 30, 1992

[51] Int. Cl.[5] ..... E01C 11/22

[52] U.S. Cl. ..... 425/64; 404/98; 425/192 R; 425/429; 425/432

[58] Field of Search ..... 404/98; 425/62, 63, 425/64, 192 R, 425, 429, 432

[56] References Cited

U.S. PATENT DOCUMENTS

| | | | |
|---|---|---|---|
| 2,225,015 | 12/1940 | Lebelle | 404/98 |
| 2,818,790 | 1/1958 | Caufield | 404/98 |
| 3,053,156 | 9/1962 | Jennings, Jr. | 404/98 |
| 3,137,220 | 6/1964 | Smith | 404/98 |
| 3,161,117 | 12/1964 | Supject | 404/98 |
| 3,261,272 | 7/1966 | Jennings, Jr. | 404/98 |
| 3,363,523 | 1/1968 | Brock et al. | 404/98 |
| 3,915,583 | 10/1975 | Aparicio | 404/98 |
| 3,915,584 | 10/1975 | Coho | 404/98 |
| 3,920,349 | 11/1975 | Jennings, Jr. et al. | 404/98 |
| 4,217,065 | 8/1980 | Stilwell | 404/98 |
| 4,298,293 | 11/1981 | Baucom | 404/98 |
| 4,310,293 | 1/1982 | Eggleton | 425/62 |
| 4,548,565 | 10/1985 | Bunn | 425/64 |
| 4,566,823 | 1/1986 | May | 404/98 |
| 4,984,932 | 1/1991 | Leone | 404/72 |
| 5,018,955 | 5/1991 | Parrish | 425/64 |

FOREIGN PATENT DOCUMENTS

| | | | |
|---|---|---|---|
| 1476357 | 4/1967 | France | 404/98 |
| 236126 | 5/1986 | German Democratic Rep. | 404/98 |

*Primary Examiner*—James Mackey

*Attorney, Agent, or Firm*—Marcus G. Theodore

[57] ABSTRACT

A manually operable and steerable curb extrusion device for extruding curb, barrier, wall, gutter or the like from concrete, cement or some other moldable building material. The curb extrusion device has a segmented vibrating hopper into which building materials are placed to fall onto two tapered counter rotating vibrating augers which compact and force the building material through an extrusion mold where it is shaped before extrusion.

9 Claims, 2 Drawing Sheets

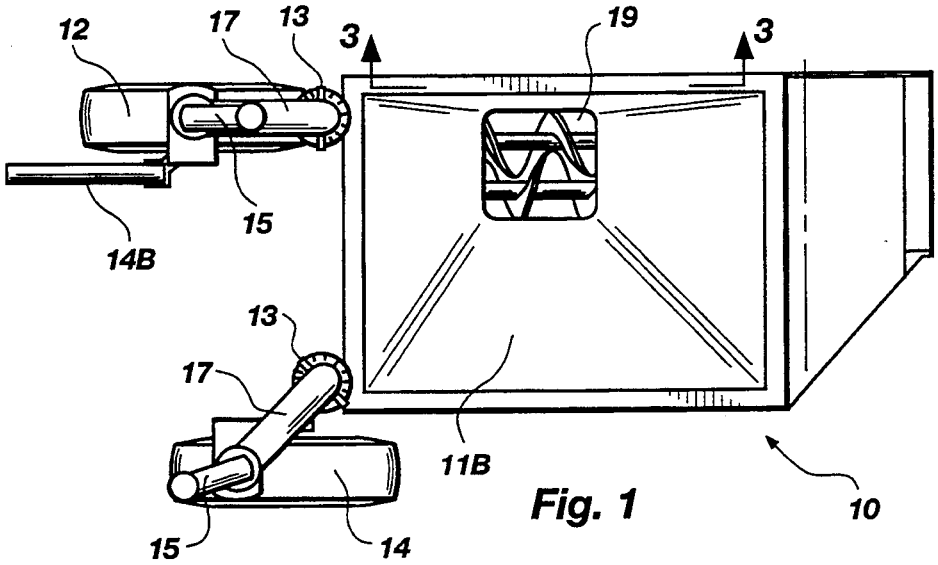
Fig. 1
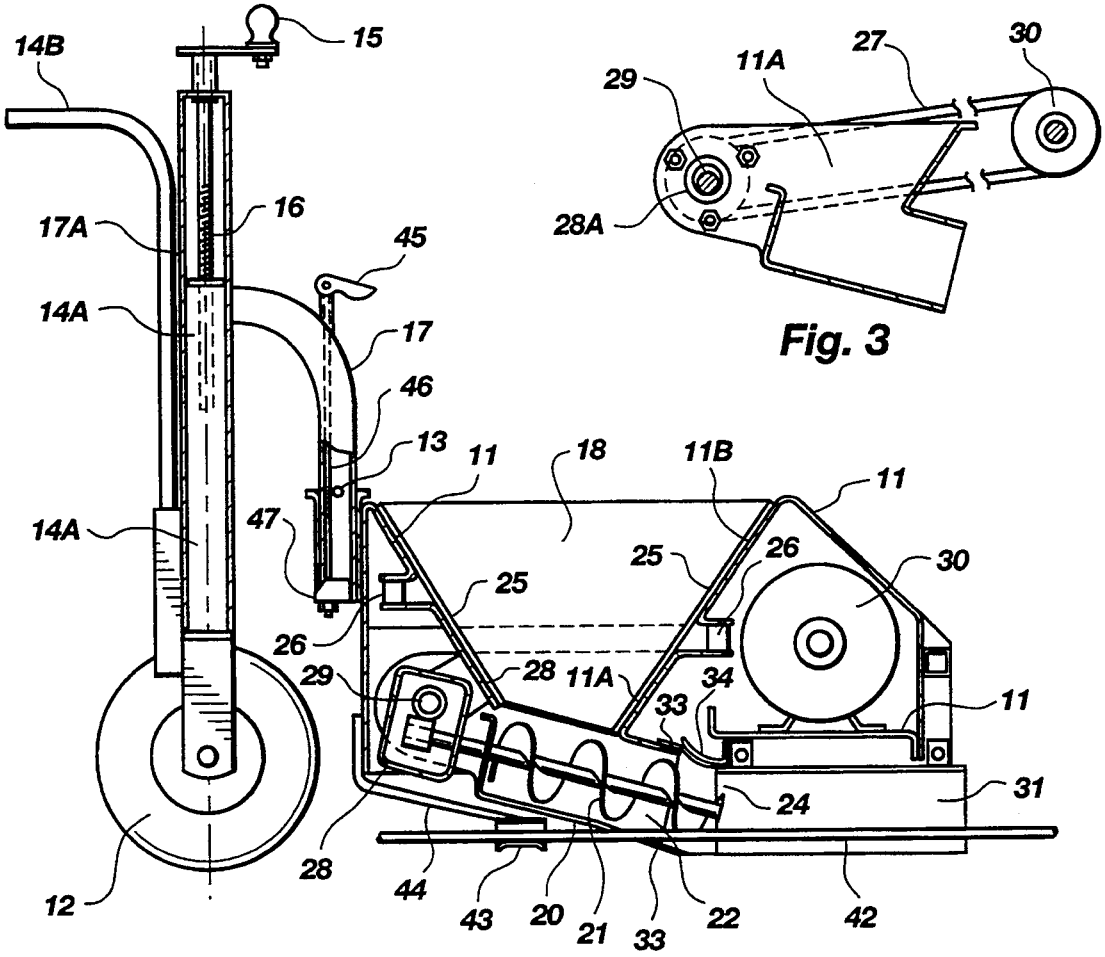
Fig. 3
Fig. 2

CURB FORMING AND EXTRUDING APPARATUS

BACKGROUND

1. Field

This invention relates to concrete curb forming and extruding apparatus. More particularly, it relates to a concrete curb forming and extruding apparatus with wheel adjustment locks, a slip form for the curb cross-section, and a straight-up side for getting close to vertical surfaces, with an extruder having a hopper with a flexible liner, augers rotating in opposite directions to compact the concrete, and a flexible member between the compaction chamber and the slip form to isolate the vibration.

2. State of the Art

Present concrete curb forming and extruding machines have a compaction member, such as a reciprocating ram or an auger to force concrete material into a slip form forming a running curb. The concrete material is usually of a dry consistency to hold the form of the curb after being extruded from the machine. The dry consistency of the material causes it to bridge from side to side in the hopper and not fall through into the compaction chamber. It is common practice to have two men run the machine-one to steer and control the machine while the other shovels small amounts of material into and through the hopper.

The ram type of curb forming and extruding machines use a gear box to reduce the speed with a crank arm connected to a flat faced member which is pushed by the crank through the compaction chamber or housing displacing the curbing material through the slip form to form the curb. May, U.S. Pat. No. 4,566,823 is an example of a manually operable curb extrusion device with interchangeable molds and compacting members wherein building material is placed in a receiving hopper and falls into a compacting chamber where a power driven and reciprocating compacting member compacts the material into the extrusion mold where it is shaped and extruded. The curb extrusion device is manually directed or steered along the desired course via an adjustable steering mechanism, and has a hopper with one straight upright side, screw-on molds, and adjustable legs connected to the wheels. Eggleton, U.S. Pat. No. 4,310,293 is another example of a ram driven concrete curb molding apparatus.

Ram machines have been the most popular because of their positive travel. However, straight compressive forces are not conducive to better compaction. Varying sizes of particles resist compaction and stack one against another, leaving voids or cavities between the particles. Voids cause porous concrete with diminished compressive test strengths. The ram of the ram curb forming machine also picks up some of the concrete material on the return back-stroke which is then deposited as a trail of material down the sides of the curb as waste. This slag has to be cleaned up or pressed down out of sight and buried. Ram machines, as the speed of the ram is increased, tend to jump ahead and then coast forward at the end of the stroke which pulls cracks in the top surface of the curb. Loose parts on the machine, such as wheels, can also leave marks in the extruded curb.

Auger type curb forming machines use an auger to move material through a compaction chamber into the slip form, are not as positive as the ram machines. They will not travel as effectively up and down hills. The auger applies pressure for compaction and forces material through the mold rearward, thereby propelling the machine forward. If the material becomes captive and turns with the auger, pressure is required to propel the machine. The compacting chamber, thus filled, causes wear and power consumption with little forward propulsion pressure being created. Smith, U.S. Pat. No. 3,137,220 discloses a curb-laying machine with a number of oppositely rotating augurs to extrude the concrete for forming curbs. Parrish et al., U.S. Pat. No. 5,018,955 utilizes a single auger to extrude the concrete and features a slip-on curb form with various adjustment options. Other examples of curb forming machines employing an auger are: Bunn, U.S. Pat. No. 4,548,565, Coho. Jr. et al., U.S. Pat. No. 3,915,584, W. E. Canfield et al,., U.S. Pat. No. 2,818,790. None of these devices avoids the augering captive material problem.

Cited for general interest are: Aparicio, U.S. Pat. No. 3,915,583 disclosing a paving machine slip form, Baucum. U.S. Pat. No. 4,298,293 disclosing a drag line operated slip form curb forming machine, and Leone, U.S. Pat. No. 4,984,932 disclosing an apparatus for continuous formation of concrete curbs via the raising and lowering of the molding to form thresholds for driveways, and intermediate tapering sections for transitions between full height curbs and thresholds.

The present invention overcomes above problems and provides an improved curb forming and extruding machine with a constant even flow of material without requiring an additional person to feed it. It also provides a curb having strong compressive strength with a smooth finished look not requiring manual troweling.

SUMMARY OF THE INVENTION

The present invention is directed to an improved manually maneuverable curb forming extruder propelled apparatus to form concrete, cementitious and other similar plastic building materials into linear curbs. It comprises a chassis frame and hopper with walls defining a compaction chamber. The compaction chamber has a rear opening through which is rearwardly directed the formed building material; thereby depositing against the ground a formed curb which simultaneously propels the apparatus forward. Steering and castering wheels are attached to the chassis frame via swinging arms which allow the wheels to be adjusted from side to side for steering to avoid obstacles in the path of the apparatus. Jack leveling means are generally associated with the swinging arms to adjust the height and level of the chassis frame so that the curb is formed to meet the needs of the user. Preferably, quick releasing arm locks are associated with the wheels to wedge the swinging arms into the desired position to prevent play or looseness.

Part of the chassis frame defines the lower segment of a flexible hopper having a bottom outlet. An upper vibrating segment of the flexible hopper is associated with the lower segment, and has a feed opening structured to receive, hold, and gravity feed building material into and through the bottom outlet. The lower hopper segment surrounds a building material compaction assembly having double counter rotating augers rotatably mounted to the chassis frame to receive from the hopper and force the building material rearward into and through the compaction chamber. Preferably the hopper has one straight up vertical side above the compaction chamber making it easier for the operator to see and get close to vertical surfaces next to the path of the new curb. The hopper also includes a flexible rubber or plastic liner in the hopper to flexibly seal the segments of the hooper and prevent the cementitious building material from sticking in the hopper.

Vibration means are associated with the double counter rotating augers and the lower segment of the hopper such that the auger and the lower segment of the hopper vibrate in opposite directions, thereby alternatively squeezing and then separating to drop the building material to continuously feed said building material into the compaction chamber by the augers to prevent bridging in the hopper and provide a more compacted building material. By vibrating the augers and compaction chamber, a more compact material is provided for producing a stronger concrete requiring less finishing because of fewer voids. It also insures that the compaction chamber is always filled, minimizing power consumption and maintaining propulsion pressure. Also, a drier better hydrated concrete material may be used to better hold the form of the curb after being extruded from the machine. Nor is there any need for two men to operate the machine-one to steer and control the machine, while the other shovels small amounts of material into and through the hopper. With the present self feeding vibrating hopper design, once the hopper is filled, the curb forming machine can be operated by one man; thereby materially reducing operating costs.

A removable slip form mold with open forward and rearward ends and an open bottom is positioned in communication with the compaction chamber rear opening to receive and sectionally form the building material into a continuous curb form. Preferably, the slip form is releasably attached via a spring bar retainer so that other interchangeable slip forms can be readily inserted to provide a curb design of the desired cross-section. Where a patterned or textured finish is desired, a rolling pattern member may be mounted to the chassis frame and positioned after the rear opening of the slip form to impress onto the surface of the newly formed curb a desired pattern finish.

A drive motor, such as an electrical or internal combustion engine, is operably associated with the rotating augers and vibration means to vibrate and turn the augers. This is accomplished by including with the drive motor a gear box mounted to the chassis frame. The walls of the gear box are then structured to form the lower segment of the hopper. An eccentric bearing is mounted and connected to the augers via an input shaft geared to run faster than the augers; thereby shaking the hopper housing in opposition to the compaction assembly.

To relieve stackup and binding and provide a more even continuous flow of the cementitious building material passing through the slip form for shaping into a continuous curb, a flexible transition member with open ends is mounted in communication between the compaction chamber rear opening and the forward opening of the slip form. This flexible member contracts and expands to stabilize the pressure buildup in the apparatus; thereby providing a more uniform pressure casting material to provide better curb forming, thereby minimizing the loss of excess slag extruded material while minimizing finishing time.

Where reinforcing bars or rods are required, a guide with an opening sized to accommodate the rods is attached to the chassis frame beneath the apparatus. In addition, the transition member is generally formed of two hinged half sections of a pipe forming an open slot directed toward the ground which passes over the rod or rods; thereby forming a curb about the reinforcing bars or rods.

The present invention therefore provides an efficient single operator curb forming machine which minimizes waste, and provides exceptional compacted concrete curbs which require minimal finishing.

DESCRIPTION OF THE DRAWINGS

FIG. 1 is a top view of a preferred embodiment of the invention.

FIG. 2 is a side view of a preferred embodiment of the invention.

FIG. 3 is a top view of a preferred embodiment of the belt drive of the compaction assembly of the invention.

DESCRIPTION OF THE ILLUSTRATED EMBODIMENTS

Figure 4:
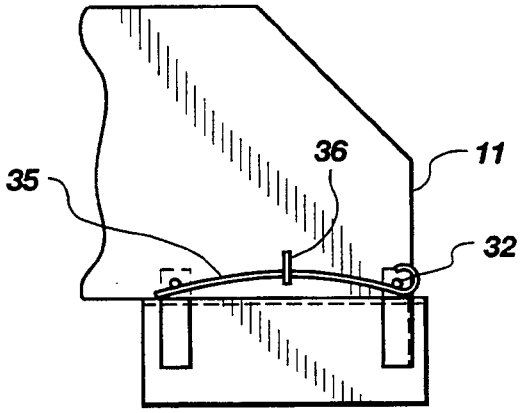
FIG. 4 is a top view of the slip form retaining system.

FIG. 1 is a top view of a preferred embodiment of the curb forming and extruding apparatus invention 10. A chassis frame 11 has a steering wheel 12 pivotally attached to a wheel leg 17 and secured via a position locking pin 13. A second castering wheel 14 is also pivotally attached to a castering wheel strut 14*a* shown in FIG. 2 and secured via a second positioning locking pin 13 for said wheels 12, 14 to support and allow the curb forming and extruding apparatus to roll in alignment to position the curb to be laid. The wheels 12, 14 are elevated via jack cranks 15 which operates a jack screw 16 and jack screw nut 17*a* operably associated with the steering wheel struts 14*a* to elevate the curb forming device 10 to the desired height as shown in FIG. 2.

Associated with the steering wheel 12 strut assembly 14*a* is a steering handle 14*b* to assist an operator in controlling and aligning the curb forming machine 10.

The chassis frame 11 defines the lower segment 11*a* of a segment of a split hopper having an upper segment 11*b* operably associated therewith. The upper segment 11*b* has a feed opening 18 held above the chassis frame 11 and structured to receive, hold, and gravity feed building material through the lower segment 11*a* having a bottom outlet 19. The lower hopper segment 11a surrounds a building material compaction assembly 20 having double counter rotating augers 21 with tapered ends 22 rotatably mounted to the chassis frame 11 to receive from the hopper bottom outlet 19 and force the building material rearward into and through the compaction chamber 23 defined by the chassis frame 11. The compaction chamber 23 has a rear opening 24 through which is rearwardly directed the formed building material; thereby depositing against the ground the formed curb which simultaneously propels apparatus 10 forward.

Figure 5:
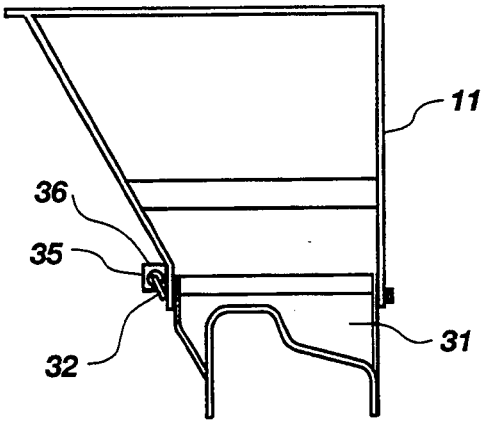
FIG. 5 is a side view of the slip form retaining system.

Preferably the hopper 11 has one straight up vertical side above the compaction chamber 23 as shown in FIGS. 1 and 5 making it easier to see to align and get close to vertical surfaces next to the path of the new curb. The hopper 11 also includes a flexible rubber or plastic liner 25 in the hopper to flexibly seal the two segments 11*a*, 11*b* of the hopper 11 and prevent the cementitious building material from sticking in the sides of the hopper 18. The two segments 11*a*, 11*b* of the hopper 11 are held together with flexible connections 26 which allow the segments 11*a*, 11*b* to independently vibrate.

As shown in FIG. 3, the double counter rotating augers 21 are belt 27 driven via a gear drive 28 with an eccentric bearing 28*a* associated with the input shaft 29 and an electric motor 30 attached to the chassis frame 11. The motor 30 does not only drive the augers 21, but it independently vibrates the augers 21 and lower segment 11*a* of the hopper 11. This is accomplished as shown in FIG. 2 wherein a gear box drive 28 is mounted to the lower segment 11*a* of the hopper defined by the chassis frame 11. An eccentric bearing mounting 28*a* connection turns the augers 21, while at the same time forcing the lower segment 11*a* of the hopper housing in opposition to the augers 21 such that the augers and the lower segment of the hopper vibrate in opposite directions. The eccentric bearing 28*a* is mounted and connected to the augers 21 via an input shaft 29 driven by the motor 30 and geared to run faster than the augers 21; thereby shaking the lower segment 11*a* of hopper 11 in opposition to the compaction assembly 20.

Figure 6:
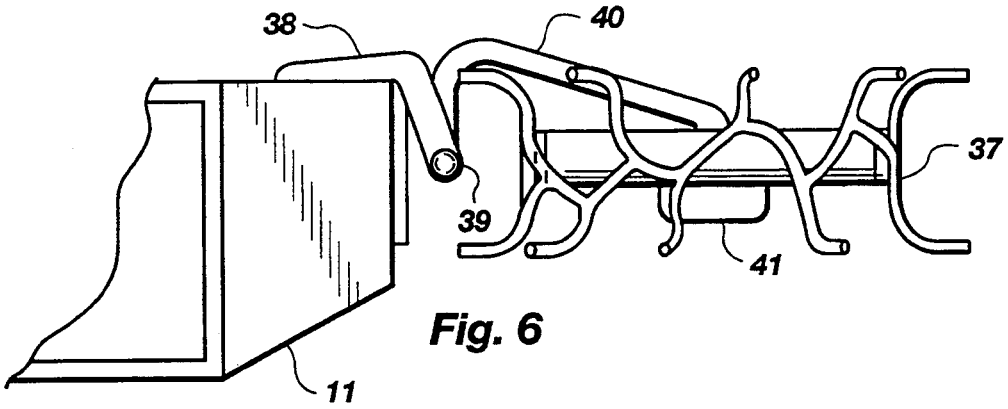
FIG. 6 is a top view of the pattern wheel.
Figure 7:
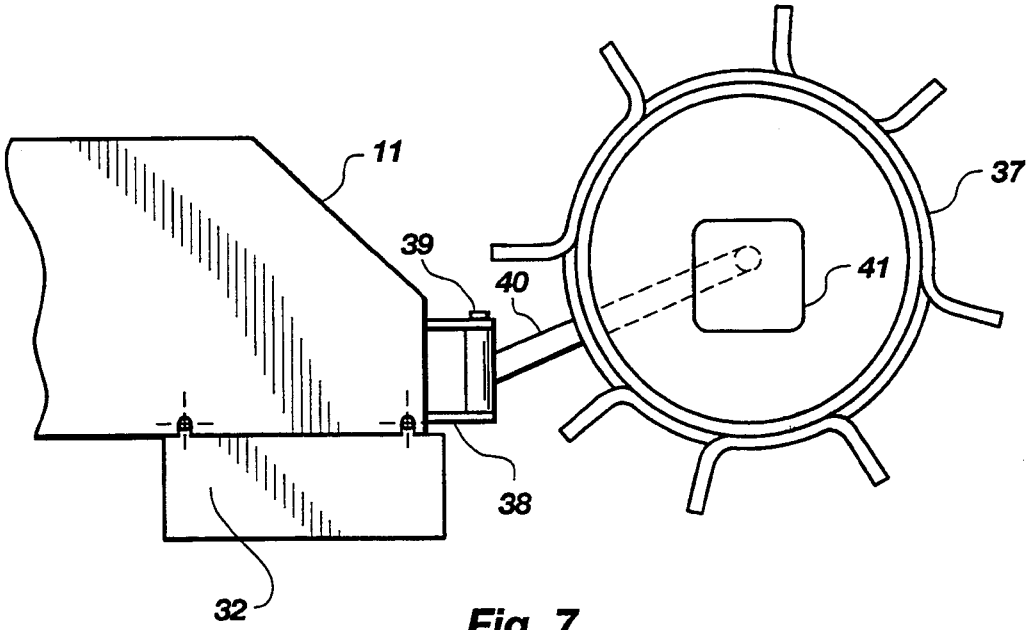
FIG. 7 is a side view of the pattern wheel.

A removable slip form mold 31 with open forward and rearward ends and an open bottom is positioned in communication with the compaction chamber rear opening 24*a* to receive and sectionally form the building material into a continuous curb form. Preferably, the slip form 31 has a button 32 which is releasably attached via a spring bar retainer 35 shown in FIGS. 4 and 5 so that other interchangeable slip forms 31 can be readily inserted to provide a curb design of the desired cross-section. An eye 36 is removably attached to the preloaded spring bar 35 to secure to a button 32 on the form 31.

Where a patterned or textured finish is desired, a rolling pattern member 37 shown in FIGS. 6 and 7 may be mounted to the chassis frame 11 via a mounting bracket 38 connected to a trailing pivot 39 attached to a trailing pivot 40 and positioned after the slip form has formed the curb to impress onto the surface of the newly formed curb a desired pattern finish.

To relieve stackup and binding and provide a more even continuous flow of the cementitious building material passing through the slip form 31, a flexible transition member 33 with open ends is mounted in communication with between the compaction chamber rear opening 24 and the forward opening of the slip form 31. This flexible transition member 33 contacts and expands to stabilize the pressure buildup in the apparatus 10, as well as isolates the vibration from the slip form 31.

Where re-bar reinforcement is required, such as that shown in FIG. 2 as 42, a guide 43 attached to a support bracket 44 mounted underneath the frame 11 is included. The apparatus 10 is then position to run along the rebar 42 just below the tapered ends 22 of the augers 21 to form the curb around the same. To insure proper alignment of the apparatus 10, a lock handle 45 with a lock pull rod 46 and lock wedge 47 is associated with the jack cranks 15 to secure the same in the desired position.

The present invention 10 therefore provides a self feeding curb forming machine which can be operated by one person, and provides a very compact extruded curb which does not have excess slag and requires minimal finishing.

Although the above description refers to the illustrated embodiments, it is not intended to restrict the scope of the appended claims. The claims themselves contain those features deemed essential to the invention.

I claim:

1. A manually maneuverable curb forming extruder propelled apparatus for concrete, cementitious and plastic building materials comprising:

a. a chassis frame with walls defining a lower segment of a feed hopper leading into a compaction chamber having a front and rear with a rear opening which directs building material rearward to propel the chassis frame forward, b. steering and castering wheels attached to the chassis frame via swinging arms which allow the wheels to be adjusted from side to side for manual steering of the apparatus, c. an upper segment of the feed hopper having a feed opening attached above the lower segment of the feed hopper structured to receive, hold, and gravity feed building material into and through the lower segment of the feed hopper and said feed hopper having a bottom outlet segment in communication with d. a compaction assembly defining the compaction chamber and rear opening and having juxtaposed double counter rotating augers each having a decreasing tapered cross-sectional diameter with each auger's largest cross-sectional diameter positioned toward the front of the compaction chamber and thereafter gradually decreasing toward the rear of the compaction chamber and rotatably mounted to the chassis frame in communication with the bottom outlet segment of the hopper within the compaction chamber such that front segments of the augers receive building materials from the bottom outlet segment of the hopper and force the building material rearward into and through the rear opening of the compaction chamber, e. vibration means associated with the double counter rotating augers and the lower segment of the hopper such that the augers and the lower segment of the hopper vibrate in opposite directions, alternatively coming together and then separating to drop the building material onto the augers for continuous compaction and feed of said building material to prevent bridging in the hopper and provide a more compacted building material, f. a removable slip form with open forward and rearward ends and an open bottom in communication with the compaction chamber rear opening to receive and sectionally form the building material into a continuous curb form, and g. a drive motor associated with the rotating augers and vibration means to vibrate and turn the augers.

2. A manually maneuverable curb forming extruder propelled apparatus according to claim 1, including leveling means associated with the swinging arms to adjust the height and level of the chassis frame.

3. A manually maneuverable curb forming extruder propelled apparatus according to claim 1, wherein the drive motor includes a gear box mounted to the lower segment of the hopper defined by the chassis frame with an eccentric bearing mounting connection turning the augers, while at the same time forcing the lower segment of the hopper in opposition to the augers such that the augers and the lower segment of the hopper vibrate in opposite directions.

4. A manually maneuverable curb forming extruder propelled apparatus according to claim 1, including a rubber liner in the hopper to flexibly seal the upper and lower segments of the hopper.

5. A manually maneuverable curb forming extruder propelled apparatus according to claim 1, including a flexible transition member with sidewalls defining open ends mounted in communication between the compaction chamber rear opening and the open forward end of the slip form, wherein the sidewalls can expand and contract to relieve stackup and binding to provide a more even continuous flow of building material for shaping through the slip form.

6. A manually maneuverable curb forming extruder propelled apparatus according to claim 5, including a guide with an opening mounted to the chassis frame beneath the compaction assembly and structured to accommodate and travel along a reinforcing rod to align the apparatus and form a finished curb about said reinforcing rod.

7. A manually maneuverable curb forming extruder propelled apparatus according to claim 1, wherein the slip form is releasably attached via a spring bar retainer.

8. A manually maneuverable curb forming extruder propelled apparatus according to claim 1, including a rolling pattern member mounted to the chassis frame and positioned after the open rearward end of the slip form to impress a desired pattern finish onto the surface of the formed finished curb.

9. A manually maneuverable curb forming apparatus including a feed hopper having a lower segment defined by walls of a chassis frame and an upper segment attached above the lower segment, the feed hopper having a bottom outlet communicating with a compaction assembly, the compaction assembly including double counter-rotating augers mounted to the chassis frame and a compaction chamber having a rear opening communicating with a removable slip form, vibration means associated with the double counter-rotating augers and the feed hopper lower segment such that the augers and the lower segment of the feed hopper vibrate in opposite directions, and a drive motor associated with the augers and the vibration means to vibrate and turn the augers.

* * * * *